United States Patent [19]

Shubow

[11] 4,343,125

[45] Aug. 10, 1982

[54] BUILDING BLOCK MODULE AND METHOD OF CONSTRUCTION

[76] Inventor: Calvin Shubow, 30995 Hunter's Dr., Farmington, Mich. 48024

[21] Appl. No.: 168,992

[22] Filed: Jun. 15, 1980

[51] Int. Cl.[3] ..... E04B 2/06

[52] U.S. Cl. ..... 52/236.8; 52/405; 52/438

[58] Field of Search ..... 52/405, 236.8, 438, 52/437, 439, 596, 600, 601, 565

[56] References Cited

U.S. PATENT DOCUMENTS

| | | | |
|---|---|---|---|
| 2,269,018 | 1/1942 | Guignon | 52/405 X |
| 2,851,873 | 9/1958 | Wheeler-Nicholson | 52/438 X |
| 2,969,619 | 1/1961 | Didkick | 52/601 |
| 3,623,291 | 11/1971 | Dussel | 52/405 X |
| 3,881,289 | 5/1975 | Mauroner | 52/600 X |
| 4,038,798 | 8/1977 | Sachs | 52/438 X |
| 4,206,577 | 6/1980 | Moriez et al. | 52/596 X |

FOREIGN PATENT DOCUMENTS

| | | | |
|---|---|---|---|
| 2747950 | 5/1979 | Fed. Rep. of Germany | 52/405 |

*Primary Examiner*—J. Karl Bell

*Attorney, Agent, or Firm*—Krass, Young & Schivley

[57] ABSTRACT

A method of construction is disclosed employing reinforced concrete building block modules which are assembled into load bearing walls. The modules are configured as hollow rectangles with each of the corners beveled and with reinforcing rods extending through each of the top, bottom and sides of the rectangle and into the bevel spaces. After assembling the modules into wall structures, the adjacent reinforcing rods are joined to each other and the bevel spaces filled in with concrete. The modules are optionally provided with attached or integrally formed exterior and/or interior facing panels and the hollow space within each module is adapted to be filled with foam insulation. In the resulting wall structure, the sides of each of the modules act as load bearing columns supporting the building floors, with the weight thereof transmitted into the columns by the top of each module acting as an arch. In an alternate form of the invention, the connection between reinforcing rods is provided by tensioning arrangements which also draw the block modules and floor together.

10 Claims, 9 Drawing Figures

Fig-1
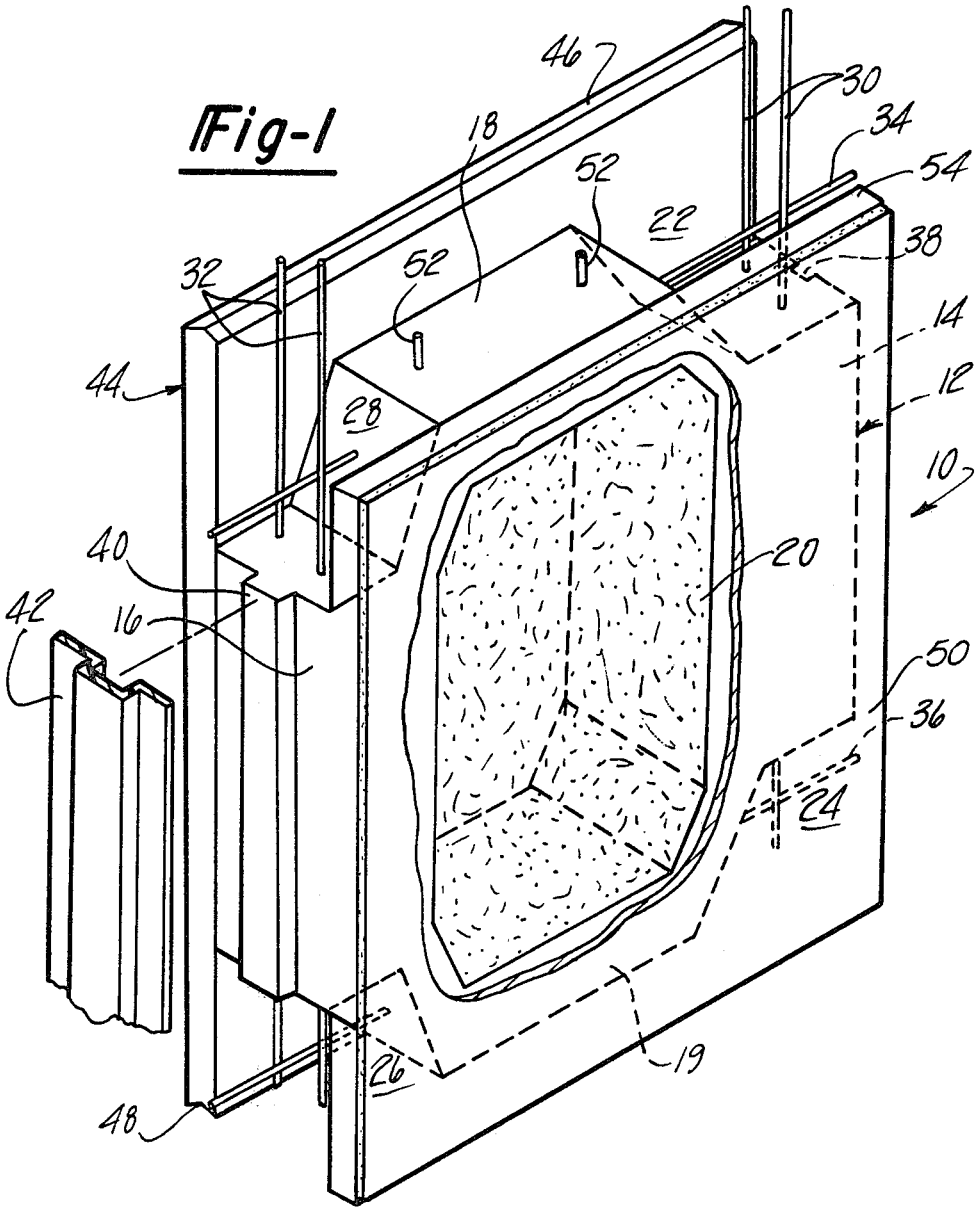
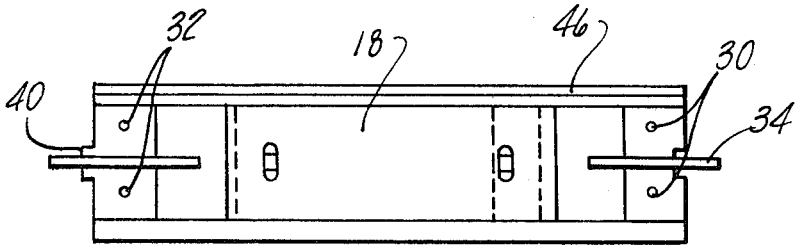
Fig-2

BUILDING BLOCK MODULE AND METHOD OF CONSTRUCTION

BACKGROUND ART

This invention concerns building construction and more particularly a precast building block module and method of constructing buildings utilizing the module. A common form of modern building construction is steel frame in which columns and beams of structural steel are assembled into a framework which supports the weight of the walls, floors and other components of the building, which are secured to the framework. Such construction is relatively expensive due to the high cost of structural steel and requires relatively expensive on site labor for the installation of the walls and ceiling panels to the steel framework.

In an effort to reduce the costs of construction for relatively low-rise buildings, i.e. 20 stories or less, reinforced concrete construction has also been commonly employed. In such construction, concrete forms are erected at the site, steel reinforcing rods placed in the forms, and concrete poured into these forms to create walls, load bearing columns, and floors of reinforced concrete. The interior and exterior facing panels are then secured to the reinforced concrete structure resulting in reinforced concrete structure. Concrete is much less expensive than steel as a structural material, and material costs are greatly reduced in this latter construction. However, on site labor is still quite extensive and thus this method still results in expensive construction. On site labor is carried out under uncontrolled site conditions, and the resultant scheduling problems resulting from the need for on time arrival of materials and various types of workers all escalate the cost of such labor over the costs of factory labor. For these reasons, fabrication of construction components can be carried at much lower costs in factory settings.

Other forms of construction have also been utilized, such as solid or hollow block walls, but this construction requires relatively intensive labor and also requires separate on site attaching of the exterior and interior panels.

In an effort to reduce the on site labor involved in reinforced concrete type construction, it has heretofore been proposed and implemented to utilize a special prefabricated form for pouring concrete as disclosed in U.S. Pat. No. 4,098,042. This patent describes a system for carrying out building construction by use of prefabrication sheet metal concrete forms to enable the reinforced concrete construction to be more rapidly carried out to greatly reduce the on site labor. However, considerable on site labor remains in the pouring of the concrete and in the installation of the interior and exterior facing panels as well as any required insulation.

Accordingly, it is an object of the present invention to provide a method of erecting and system of wall and floor structure, and a prefabricated building block module utilized therein which results in a reinforced concrete structure with a great reduction in on site labor.

It is still another object of the present invention to provide such method and module by which the on site labor in installing the wall insulation and the exterior and interior wall panels is greatly reduced.

Still another object of the present invention is to provide a building block module and system and method of wall and floor construction of reinforced concrete by which the extent of on site pouring of concrete is minimized.

It is still another object of the present invention to provide such a method and module for reinforced concrete construction in which the necessity for the on site erection of concrete forms is substantially eliminated.

DISCLOSURE OF THE INVENTION

These and other objects of the present invention are achieved by a method in which precast building block modules of precast reinforced concrete are erected into vertical walls which are integrated into a wall-floor system, whereby the walls support the building floors. The building block modules consist of generally rectangular hollow blocks of reinforced concrete, with generally beveled corners. Reinforcing bars or rods are cast within each of the sides, top and bottom of the module and extend into and through the spaces created by the beveling of the corners.

The spacing of the sides of the rectangular module is such as to correspond to the necessary column sizing and spacing for the particular building design. The modules are assembled into vertical walls aligned over each other and in end to end and side and top and bottom abutment. The beveled spaces enable the vertical and horizontal rods to be rerodded together with the spaces then filled with concrete to form solid columns of reinforced concrete construction through which continuous reinforcing extends. The building modules are also provided with integral or separately attached external panels which come into abutment to provide the building exterior face when the modules are assembled into the walls.

The building floors are poured or precast floor sections are assembled into position atop the building modules with the beveled tops each acting as arches transmitting the weight of the floor into the vertical columns formed by the module sides.

The sides of the modules are provided with tongue and grooves on opposite sides which are in mating relationship upon assembly of the modules into the walls. The modules are also provided with insulation material filling the hollow space within the interior of each module. In addition, interior wall panels may be assembled to each of the interior faces of the modules. All of the building block modules as well as attached exterior and interior wall panels are prefabricated at factory sites, such that the on site labor is greatly reduced to greatly reduce building labor costs, while providing the material cost reduction advantage of reinforced concrete construction.

The enablement of the rerod connection in the spaces provided by the beveled corners enables continuously extending vertical and horizontal reinforcing rods to provide continuous reinforcement of the columns and beams formed by the module top and sides. The connections at the ends of the reinforcing rods may be made by welding, twisting or otherwise connecting the ends of the reinforcing rods.

In a second embodiment, the reinforcing rods are provided with threaded connections, which cooperate with threaded coupling elements so as to draw together the individual modules into tight side and top and bottom abutment with each other and the floor sections.

The vertical reinforcing rods are coupled by a sleeve capturing a headed end on one of the reinforcing bars and threadedly engaging the other end of the other aligned reinforcing bar to facilitate positioning of each of the modules atop each other. The sleeve is slotted to enable subsequent installation of the sleeve over the headed end of one of the aligned reinforcing rods and movement into threaded engagement with the other end of the opposing reinforcing bar end. In this embodiment, precast floor sections are employed which are provided with horizontally extending internal spaces which accommodate turn-buckle assemblies each anchored at one end on transverse rods embedded in the floor section and extending through the floor spaces. The other end of each of the turn-buckles are anchored over a vertical rod extending out of each side of the module into the beveled space, which arrangement enables the floor and modules to be drawn tight together by rotation of the turnbuckle.

DESCRIPTION OF THE DRAWINGS

FIG. 1 is a perspective view of the building block module according to the present invention with an exploded fragmentary view of an edge seal assembled into the side space between adjacent module.

FIG. 2 is a top view of the module shown in FIG. 1.

DETAILED DESCRIPTION

Figure 3:
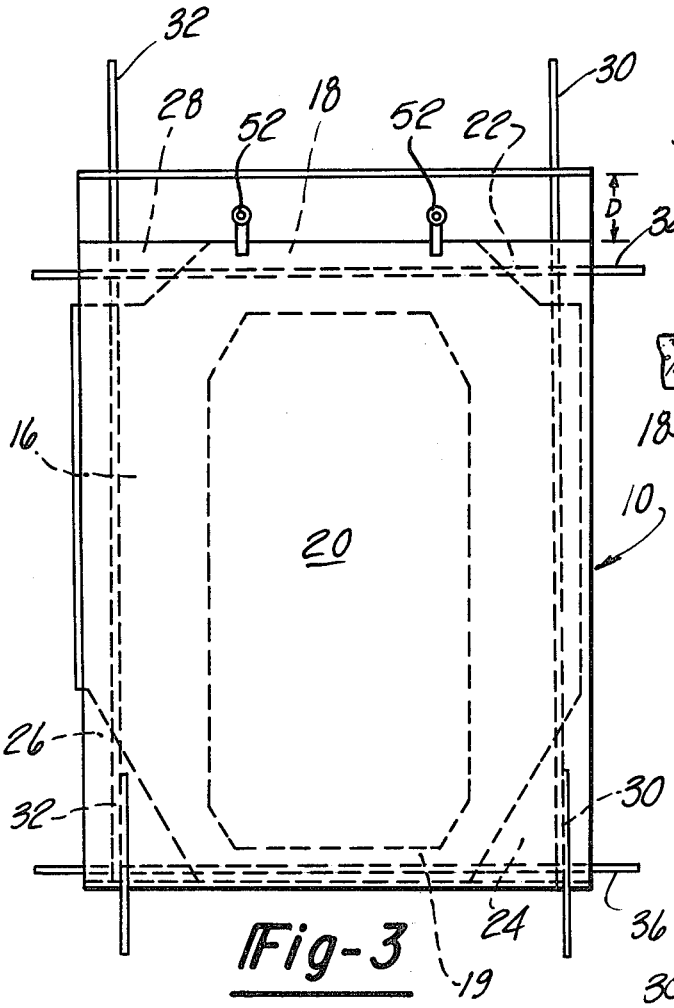
FIG. 3 is a front elevational view of the module shown in FIG. 1.

In the following detailed description, certain specific terminology will be employed for the sake of clarity and particular embodiments described in accordance with the requirements of 35 USC 112, but it should be understood that the same is not intended to be limiting and indeed should not be so construed.

Referring to the drawings, and particularly FIGS. 1–4, according to the concept of the present invention a plurality of precast reinforced concrete building block modules 10 are utilized which are assembled into load bearing walls of the building structure. According to accepted construction techniques for erecting reinforced concrete buildings, reinforced concrete columns are provided which extend to the full height of the building, the concrete columns having iron or steel reinforcing rods embedded therein. Such steel reinforcement bars must extend continuously through the full height of the column, according to accepted building practice.

In the normal procedure for achieving this the reinforcing rods are of length to extend above the height of the column after pouring of the concrete. The reinforcing rods for the next aligned column section are "rerodded" or joined to the protruding lengths of reinforcing rods. Each column section corresponds to a building story, such that each floor section is poured or assembled onto bond beams extending between the columns, such that the weight of each floor is born by the respective column section.

The bond beam similarly is provided with a continuously joined steel reinforcing rods extending throughout the lengths of the bond beam.

According to the concept of the present invention each of the prefabricated building modules 10 comprise a structure which acts as a pair of column sections as well as an adjacent connecting bond beam which transmits the load of the floor into the columns. A particular configuration of the building module 10 enables ready joining of the column sections into continuously reinforced vertical columns extending throughout the full height of the building.

Each building module 10 includes a generally rectangular precast reinforced concrete member 12 having side sections 14 and 16 joined by a top section 18 and a bottom section 19. A central hollow 20 is formed by the surrounding rectangle top, sides and bottom.

Each of the corners of the rectangular precast concrete member 12 are generally beveled to formed spaces indicated at 22, 24, 26 and 28 in FIG. 1. The beveling of the bottom spaces 24 and 26 is more steeply vertical while the spaces 22 and 28 at the top are more horizontally inclined. Each of the sides 14 and 16, the joining top section 18 and bottom section 19 have sections of reinforcing rods 30 and 32 cast thereinto. The number and size of such rods is determined by the design of the particular building in question, as is the spacing of the sides 14 and 16, and the sizing of the various sections.

The reinforcing rods 30 in the side section 14 and 32 in the side section 16 have their upper ends extending through the bevel spaces 22 and 28 to protrude well beyond the upper surface of the top section 18. However, the reinforcing rod ends extending into the spaces 24 and 26 extend only as far as the bottom surface of the bottom section 19. The reinforcing rods 34 within the top section 18 extend out of the bevel spaces 24 and 26. This arrangement enables connections between the aligned opposing rod ends after assembly into a wall structure, as will be described below.

Each of the sides 14 and 16 are provided with complementary lengthwise extending mating contours provided for side engagement between adjacent building modules, i.e., side 14 is provided with a lengthwise groove 38 while side section 16 is provided with a lengthwise tongue 40.

Suitable seals are provided such as neoprene seal 42 of a complementary shape to be interposed between adjacent side sections in order to provide a weather tight joint.

The building block module may also be provided with either integral or attached exterior wall panels 44 which may also be of poured concrete. Such panels generally overlie the hollow rectangular member 12 and having an upper area extending above the upper surface of the top section 18, for a distance corresponding to the floor depth to accommodate its thickness. The top surface 46 is chamfered in order to provide a weather lap joint between overlying the bottom edge 48 of the next above exterior panel of the module 10 positioned directly above in the building structure. The bottom contour 48 is wedgeshaped in a complementary fashion for this purpose.

The module 10 may also be optionally provided with an interior wall panel 50 which also overlies the inside flanged face of the hollow rectangular member 12, the flange 13 extended over the bevel spaces 22, 24, 26 and 28 as shown. Panel 50 may be a section of drywall or other suitable interior facing material. Alternatively, the interior surfaces may simply be plastered after assembly of the modules 10 into the wall structure.

The hollow interior space 20 may also be filled with a mass of insulating material such as foamed plastic or other suitable insulating material when the module 10 is prefabricated. This may also be done after the building structure has been erected.

A vapor barrier indicated at 52 is provided overlying the hollow rectangular member 12 underneath the interior wall panel 50. Suitable cast in lifting eyes 52 may also be provided or to facilitate hoisting of each building module 10 into position which will also act as keys when embedded in a poured concrete flooring section.

Figure 4:
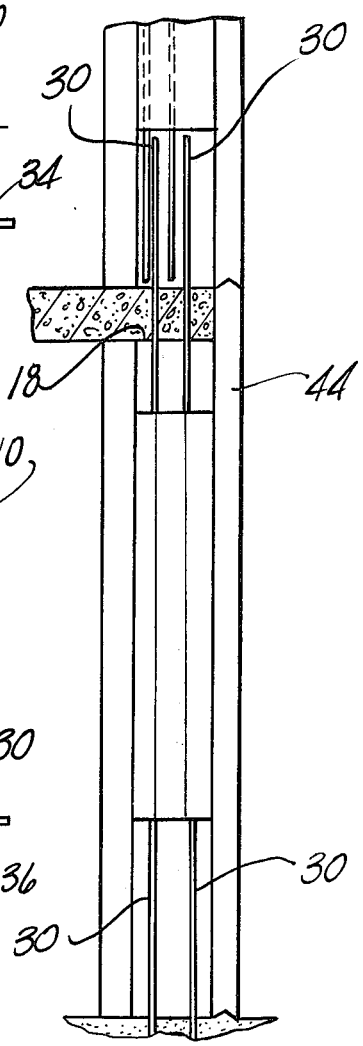
FIG. 4 is a side elevational view of an assembly of the modules into a load bearing building wall-floor structure system.

According to FIGS. 4 and 5, the erected floor wall system is comprised of a series of building modules 10 assembled in side by side relationship with the tongue and grooves 38 and 40 in mating relationship, with each of the sides 14 and 16 aligned with the below positioned module 10 having corresponding sides 14 and 16.

The initial or first course of building modules 10 are of special configuration in order to be assembled to the foundation structure 56, which may be of poured concrete construction formed with core openings 58 which are spaced at the spacing S corresponding to the designed column spacing of the building structure. Thus the core openings 58 can be filled with high strength concrete and receive the bottom ends of reinforcing rods which, in this version of the building modules 10, extend below the bottom section 19.

Each of the building modules 10 in this procedure would be placed in edge abutting relationship and in alignment with each other with the appropriate seals 42 in place to form a wall. After placement of the first course, each of the building modules provide column sections comprising sides 14 and 16. The floor sections 60 are either assembled or poured in place such as to overlie the top beam 18. In this case the lifting eyes 52 act to tie in the floor to each building module 10.

The offset distance D is the dimension in which the exterior panel 44 extends above the top of the beam 18 or top side 18 corresponds to the depth of the floor 60. Of course it should be understood that in the event the floor 60 is poured on site, the necessary forms, supports, etc., must be erected if the floor 60 is of a precast configuration, necessary the fastening hardware must be employed in a manner known to those skilled in the art.

Figure 5:
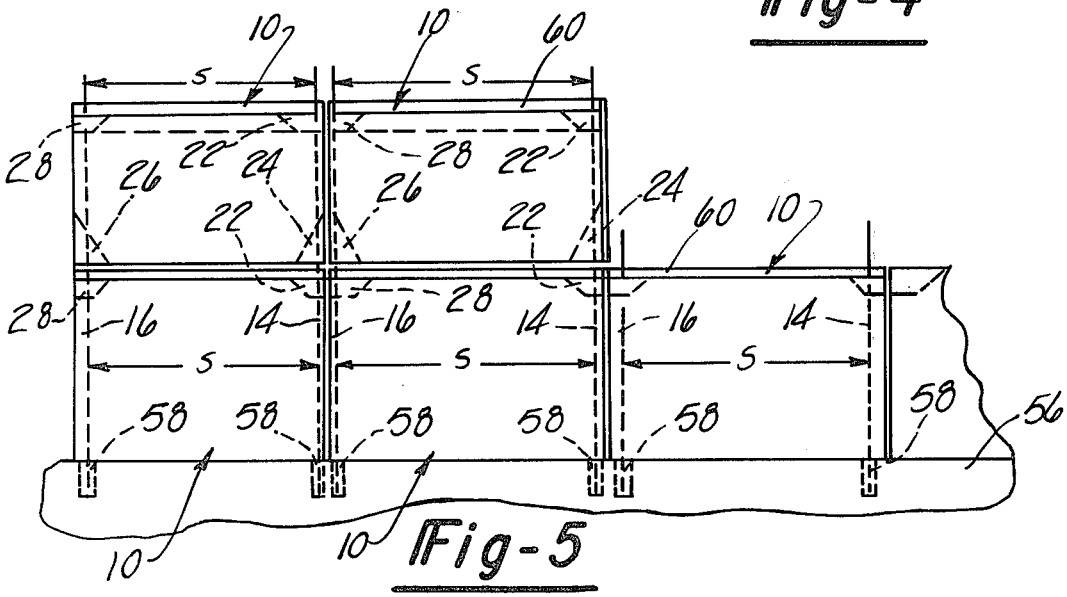
FIG. 5 is a diagrammatic front elevational view of a series of modules assembled into a load bearing wall-floor structure.
Figure 6:
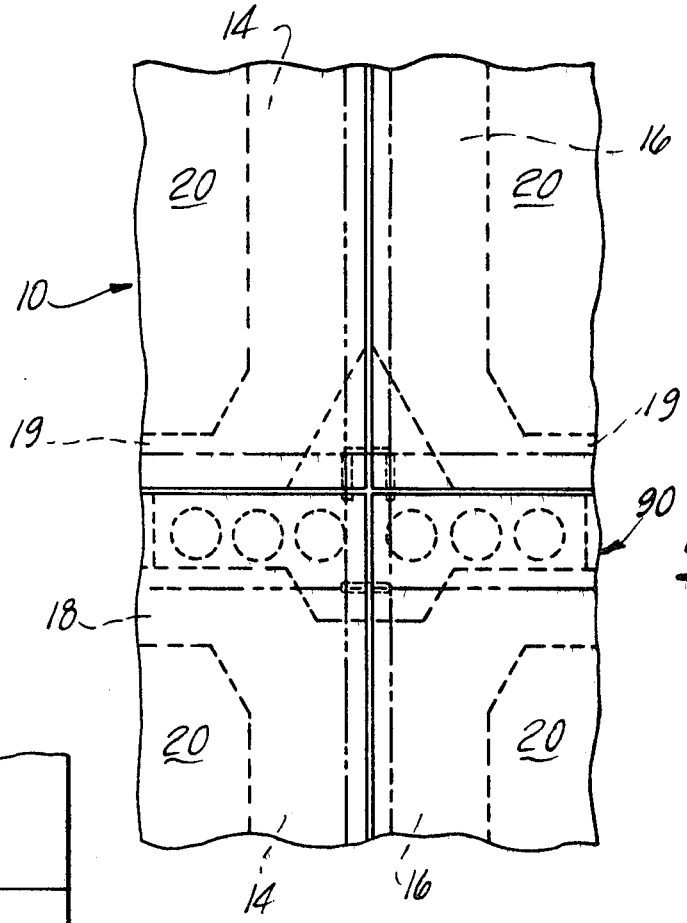
FIG. 6 is an exterior elevational view of a series of modules of alternate form assembled into a wall-floor structure.

The spacing S noted in FIG. 5 equal to the distance between the columns, constituted by the sides 14 and 16 of course, will be determined by the design of the particular building as will be the sizes of the sides 14 and 16, top section 18, and the size and number of reinforcing rods 30 and 32.

After placement of floor 60, the next succeeding course of building modules 10 is assembled into position with each building module 10 aligned and having its sides 14 and 16 in direct alignment with the next below module sides 14 and 16.

This positions the upper ends of the reinforcing rods 30 and 32 protruding into the beveled spaces 26 and 30 so that they may be brought into overlapping relationship with the lower ends of the reinforcing rods 30 and 32 of the next above building module 10. The rods 30 and 32 then may be rerodded or joined as by wiring or welding as per conventional techniques. Access thereto for this purpose is afforded by the beveled spaces 24 and 26 of the upper modules 10.

Similarly cross reinforcing rods 32 and 36 extend into adjacent bevel spaces 22, 24, 26 and 28 enabling lapping of adjacent rods and rerodding of these. In this way the second course may be erected and the next floor if any assembled to the top of the next course of building modules 10. After assembly thereof, each of the beveled spaces 22, 24, 26 and 28 is then filled in with concrete or other similar material to provide continuous vertical columns consisting of the aligned sides 14 and 16 of each of the vertically aligned building modules 10. If insulation has not previously been filled into each of the void spaces 20, this may be foamed or otherwise installed after erection of the wall-floor structure, as well as the installing of suitable interior panels and vapor barriers, or the interior wall plastered.

It is noted that each module 10 is of a height equal to the building story and is therefore of variable width and size.

The lower section 19 not bearing the load of the floor weight is incorporated only to provide a relatively strong building module 10 which is able to be easily handled during the shipping and erection processes. It can be appreciated that the entire modules can be substantially completely prefabricated in a factory environment and thus minimize construction labor at the site, particularly if the exterior and interior panels and the insulation is incorporated in the prefabrication of the modules 10.

Also window openings may be relatively easily provided for by providing appropriate cutouts in the region of the central void space 20.

The resulting wall structure will be relatively weather type due to the sealing engagement between adjacent building modules and also the vertical and horizontal weather lap afforded by the mating of the exterior panels, which may also be caulked in conventional fashion.

Figure 8:
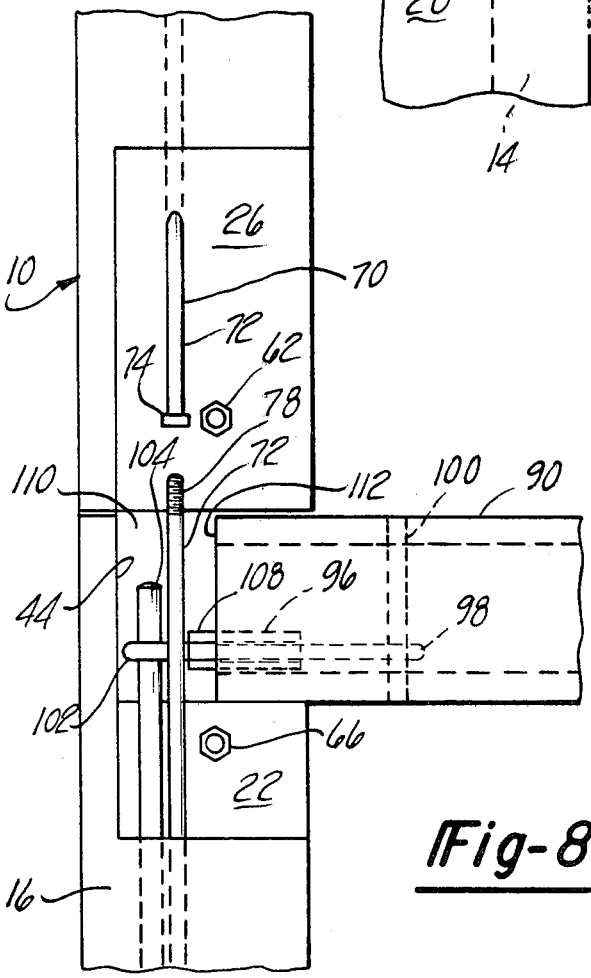
FIG. 8 is a fragmentary enlarged side elevational view showing two vertical aligned building modules of the type shown in FIGS. 6 and 7 together with a portion of floor structure showing the details of the reinforcing bars connection.
Figure 9:
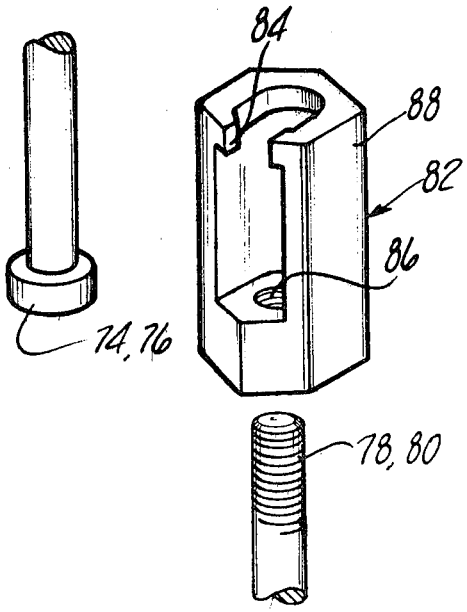
FIG. 9 is an exploded perspective of the coupling component and reinforcing rod ends connecting the vertical reinforcing rods in the embodiment of FIGS. 6–9.
Figure 7:
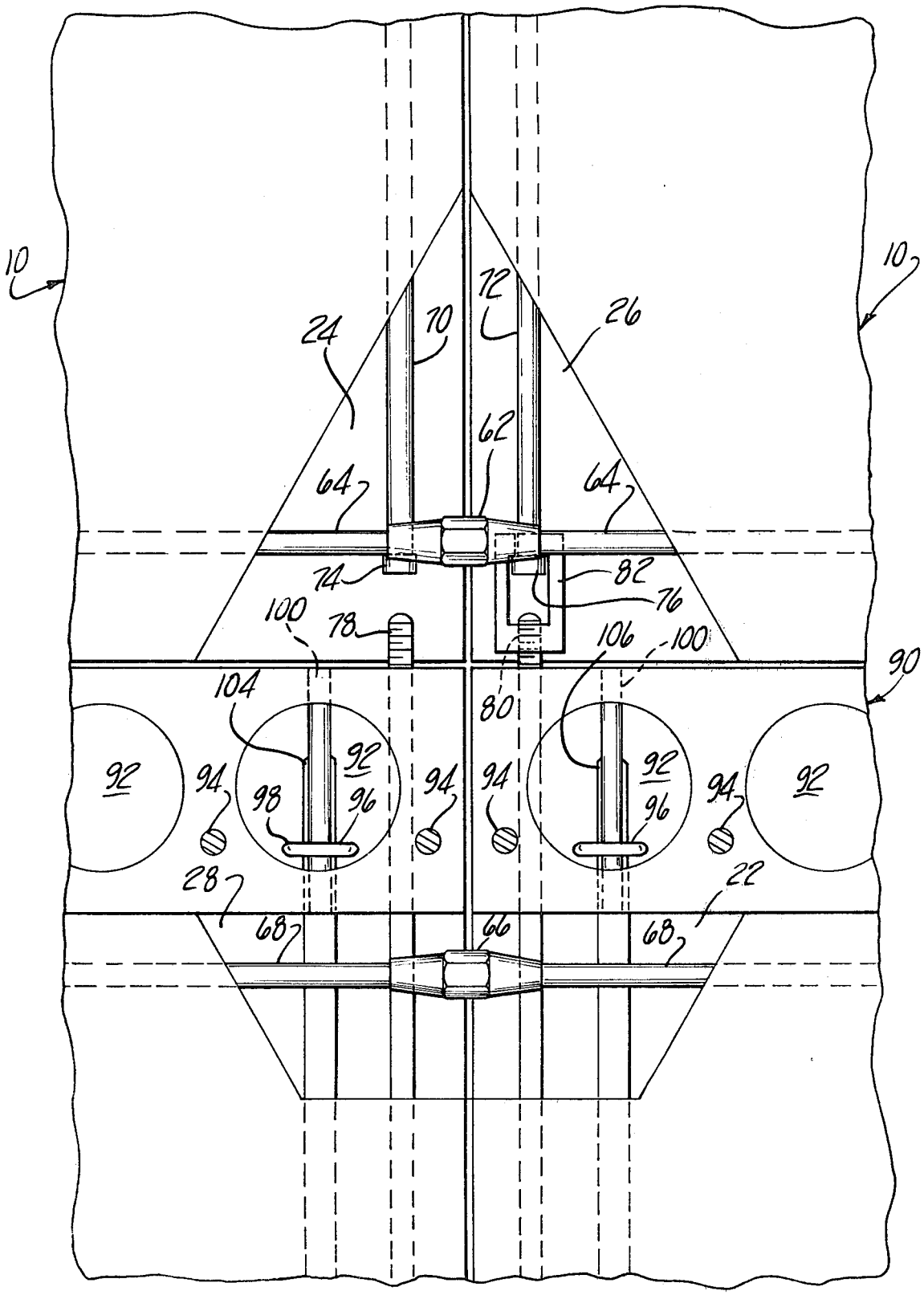
FIG. 7 is an enlarged interior elevational view of the wall-floor structure shown in FIG. 6.

It may be advantageous to provide means for drawing the modules 10 into tight engagement with the floor and the wall made up of the individual building modules 10. In FIGS. 7–9, an arrangement is depicted for causing prestress tensioning to be exerted on the reinforcing bars, and also in order to draw the panels into tight engagement with the flooring and with the adjacent building modules 10.

This arrangement is best seen in FIGS. 7 and 8. This includes a coupling 62 which mates with the aligned threaded ends of horizontal reinforcing rods 64 extending through the bottom section 19 of each member 12. In similar fashion, a coupling 66 mates with aligned and opposed threaded ends of reinforcing bars 68 extending through the top sections 18. The bevel spaces 23, 26, 22 and 28 provide the necessary access space for installation and tightening of the coupling 62 and 66.

The reinforcing rods 70 and 72 extending through each of the sides 14 and 16 of each module 10 are enabled to be drawn together and secured by means of a special fitting engaging headed lower ends 74 and 76 of each of the respective reinforcing bars 70 and 72 and the threaded upper ends 78 and 80 of the reinforcing bars 70 and 72 respectively. In the embodiment, the bars are sized so as to create a gap between the aligned and opposed upper and lower ends of the reinforcing bars upon installation of the building modules in their vertically aligned position.

After fitting each module 10 in position the special fitting 82 is slid over the threaded section 74 or 76 through a cut out or slot 84, and the threaded bore 86 moved into threaded engagement with the lower end of 78 or 80.

The exterior of the special fitting 82 is formed with wrenching flats 88 to enable the rotation of special fitting 82 to create tension on the reinforcing bars 78 and 72 to both prestress the reinforcing rods 70 and 72 and also to insure tight abutment of the adjoined floor section and each of the building modules 10.

The floor sections 90 of this configuration are of precast construction and include openings 92 which extend transversely to the building module 10. Such flooring construction is of a type known to those skilled in the art and includes steel reinforcing rod 94 in the lower regions of the floor to provide tension reinforcement. A turnbuckle fitting 96 is positioned in the core openings 92 adjacent each of the bevel spaces of building modules 10. The core openings 92 serve to accommodate these fittings. Each turnbuckle fitting 96 includes an anchoring eye 98 anchored on a transverse bar 100 extending through the floor section 90. The opposite end of the turnbuckle fitting 96 includes an anchoring eye 102 which is fit around a vertically extending bar 104 embedded into each of the side wall side sections 14 and 16, positioned offset both laterally and in and out from the reinforcing bars 70 and 72. The turnbuckle fitting also includes a turnbuckle nut section 108 protruding into the space 110 which is adjacent an end face 112 of the flooring section 90 in the exterior panel 44 of the building module. Access thereto is through the spaces 22, 26, 24 and 28 to enable wrenching of the turnbuckle nut 108.

Accordingly the reinforcing rod 70 and 72 may be prestressed and securely joined and tensioned by this arrangement and the horizontally extending reinforcing bars 64 prestressed which also causes the building modules 10 to be drawn into tight engagement with each other and with the flooring sections 90.

Accordingly, it can be seen that the on site labor required for erection is greatly reduced while producing a structure of reinforced concrete such as to reduce the material costs involved. The building modules 10 may include the external and internal finishing panels as well as insulation and vapor barrier to further reduce the on site labor and also increasing the speed with which the building may be erected to further reduce the cost of construction.

I claim:

1. A building module for use in erecting a wall load bearing structure, the building module comprising a hollow rectangular member of reinforced concrete, including a pair of sides and a connecting top section defining a central space each of said sides and top section including reinforcement bars extending there through.

2. The building module according to claim 1 wherein said rectangular member is formed with beveled corners thereof and wherein said reinforcing bars extend through each of said spaces formed by said beveled corners.

3. The building module according to claim 2 further including a bottom section connecting said member sides; said bottom section being of reinforced concrete.

4. The building module according to claim 2 further including an exterior wall panel of generally rectangular configuration overlying and secured to said hollow rectangular member top and sides.

5. The building module according to claim 2 wherein the said reinforcing bars in said sides extend beyond the top surface of said top section and through the beveled spaces adjacent thereto.

6. The building module according to claim 1 wherein said hollow space intermediate said sides is filled with insulation.

7. The building module according to claim 3 further including an interior panel secured overlying said rectangular member.

8. The building module according to claim 4 wherein said exterior wall panel has top and bottom edges formed with complementary groove shapes.

9. The building module according to claim 2 wherein each of said reinforcing bars extending through said sides includes one headed end and the other end threaded.

10. The building module according to claim 2 each of said reinforcing bars extending through said top section is formed with threaded ends.

* * * * *